US005975438A

United States Patent [19]

Garasimowicz

[11] Patent Number: 5,975,438

[45] Date of Patent: Nov. 2, 1999

[54] REFINER DISC WITH CURVED REFINER BARS

[75] Inventor: Gregory Alexander Garasimowicz, Mukwonago, Wis.

[73] Assignee: J & L Fiber Services Inc., Waukesha, Wis.

[21] Appl. No.: 09/084,655

[22] Filed: May 26, 1998

Related U.S. Application Data

[63] Continuation of application No. 08/557,510, Nov. 14, 1995, Pat. No. 5,823,453.

[51] Int. Cl.[6] ..... B02C 7/12; B02C 19/00

[52] U.S. Cl. ..... 241/15; 241/21; 241/27; 241/28

[58] Field of Search ..... 241/15, 21, 27, 241/28, 261.2, 261.3, 296, 297, 298

[56] References Cited

U.S. PATENT DOCUMENTS

| | | | |
|---|---|---|---|
| 201,784 | 3/1878 | Hess . | |
| 269,015 | 12/1882 | Conklin . | |
| 852,164 | 4/1907 | Bussinger . | |
| 1,169,228 | 1/1916 | Barker . | |
| 1,394,803 | 10/1921 | Beall . | |
| 1,556,323 | 6/1925 | Garza . | |
| 1,556,870 | 10/1925 | Nelson . | |
| 1,595,282 | 8/1926 | Bauer . | |
| 1,609,717 | 12/1926 | Holland-Letz . | |
| 1,609,718 | 12/1926 | Holland-Letz . | |
| 2,425,024 | 8/1947 | Beveridge et al. . | |
| 3,149,792 | 9/1964 | Textor | 241/261.3 |
| 3,321,809 | 5/1967 | Younk . | |
| 3,473,745 | 10/1969 | Shook, Jr. et al. . | |
| 3,674,217 | 7/1972 | Reinhall . | |
| 3,815,834 | 6/1974 | Gilbert . | |
| 3,880,368 | 4/1975 | Matthew . | |
| 4,005,827 | 2/1977 | Frair et al. . | |
| 4,011,150 | 3/1977 | Peterson . | |
| 4,023,737 | 5/1977 | Leider et al. | 241/261.3 |
| 4,023,739 | 5/1977 | Lampe et al. . | |
| 4,036,443 | 7/1977 | Saltarelli . | |
| 4,039,154 | 8/1977 | Peterson . | |
| 4,355,768 | 10/1982 | Johansson | 241/261.3 |
| 4,423,845 | 1/1984 | Frazier et al. | 241/261.3 |
| 4,529,137 | 7/1985 | Matthew et al. . | |
| 4,531,681 | 7/1985 | Matthew et al. . | |
| 4,570,862 | 2/1986 | Kirchner . | |
| 4,586,662 | 5/1986 | Goldenberg et al. . | |
| 4,614,309 | 9/1986 | Goldenberg . | |

(List continued on next page.)

FOREIGN PATENT DOCUMENTS

| | | |
|---|---|---|
| 57-8916 | 2/1982 | Japan . |
| 59-39496 | 9/1984 | Japan . |
| 61-215788 | 9/1986 | Japan . |
| 4-501290 | 3/1992 | Japan . |
| 6-510524 | 2/1994 | Japan . |
| 6-101188 | 4/1994 | Japan . |

OTHER PUBLICATIONS

Japanese Office Action No. 124729 with English translation. (No Date Given).

*Primary Examiner*—John M. Husar
*Attorney, Agent, or Firm*—Nilles & Nilles SC

[57] ABSTRACT

A disc refiner for thermo-mechanical pulping of wood chips or other fiber source for papermaking has annular refiner discs with a plurality of axially protruding radially extending curved refiner bars. Curved bars in the refiner zone should resist erosion and corrosion. Each disc has a region of bars which curve in the direction of rotation, and a region which curves away from the direction of rotation. Two identical refiner discs are mounted to rotate with respect to one another. Because of the bar curvature, processed stock experiences different angles of bar intersection as the pulp progresses from the inside of the refiner plate to the outside of the refiner plate, yielding a reduced hit on the pulp where opposed refiner bars curve in opposite directions. Where refiner bars on opposed plates curve in a like direction as they pass over one another there is a hold back action on the stock in that region.

31 Claims, 3 Drawing Sheets

U.S. PATENT DOCUMENTS

| | | | |
|---|---|---|---|
| 4,619,414 | 10/1986 | Kirchner et al. . | |
| 4,620,675 | 11/1986 | Kirchner . | |
| 4,625,926 | 12/1986 | Kirchner . | |
| 4,635,864 | 1/1987 | Peterson et al. | 241/251 |
| 4,712,745 | 12/1987 | Leith | 241/261.3 |
| 4,772,358 | 9/1988 | Virving | 241/297 X |
| 4,953,796 | 9/1990 | Virving . | |
| 5,046,672 | 9/1991 | Demler . | |
| 5,112,443 | 5/1992 | Virving et al. . | |
| 5,165,592 | 11/1992 | Wasikowski . | |
| 5,178,339 | 1/1993 | Pilao . | |
| 5,181,664 | 1/1993 | Kohler . | |
| 5,203,514 | 4/1993 | Mokvist et al. . | |
| 5,323,972 | 6/1994 | Kjellqvist . | |
| 5,823,453 | 10/1998 | Garasimowicz | 241/261.3 |

REFINER DISC WITH CURVED REFINER BARS

This application is a continuation of U.S. application Ser. No. 08/557,510, filed Nov. 14, 1995, which issued Oct. 20, 1998, as U.S. Pat. No. 5,823,453.

FIELD OF THE INVENTION

This invention relates generally to a method of refining a stock material, and more particularly to such a method utilizing a disc refiner for preparing a stock material such as paper pulp fibers and the like.

BACKGROUND OF THE INVENTION

For papermaking purposes, fibers from wood chips or other raw fiber source are ground into chips or mechanically treated such that the chips may be broken down further and refined into individual fibers.

Disc refiners are used to break down clumps of fibers into individual fibers in high density stock containing eighteen to sixty percent fiber by weight. Disc refiners are also used with low density, low consistency pulp of two to five percent fiber dry weight to increase the freeness or bonding capability of the individual fibers.

A refiner disc is a disc-shaped steel or steel-alloy casting which has an array of generally radially extending bars formed on the surface thereof. The disc refiner typically utilizes pairs of opposed refiner discs. One disc is mounted on a rotor for rotation. Another disc is held opposed to the first refiner disc, either by rigid mounting or by mounting on a rotor which turns in an opposite direction. Wood pulp is refined as it passes between the rotating opposed discs.

A refiner for high density stock employs an auger which is axially mounted with respect to the rotor on which the refining disk is mounted. A flinger nut may be positioned adjacent to the end of the auger which feeds the stock into a breaker bar section. The breaker bar section feeds the stock to the refiner disks where wood chips and clumps of fiber are broken down into individual fibers. Conventional refiner bar sections employ essentially radially extending rectilinear refiner bars on the rotor opposed by stationary essentially radially extending rectilinear bars mounted to the refiner housing.

In paper manufacture, the cost of power (electricity) and the cost of stock or wood fibers are the single largest component of the paper product's total cost. The paper fiber or stock is manufactured from wood chips which are in many respects an industrial commodity whose price is governed by the market and not easily controlled. Thus, to improve the cost and efficiency of the papermaking process, it is important to focus on reducing the cost of processing the wood chips used to produce the stock or furnish from which the paper is made. High consistency refiners used principally with mechanical or semi-chemical pulps are relatively large consumers of power. Therefore, any improvement of through-put or power utilization in the refiner can lead to significant cost and efficiency savings.

Furthermore, the vast volumes of stock which flow between the refiner discs inevitably results in wear of the refiner bars, eventually necessitating replacement of the individual refiner discs. Not only is the substitution of new refiner discs costly in terms of replacement parts, but it requires that the refiner be downed and taken out of service while the discs are replaced.

What is needed is a disc refiner which requires less frequent replacement of refiner discs, and which efficiently achieves desired pulp quality.

SUMMARY OF THE INVENTION

The disc refiner of this invention has a refiner disc having a generally annular base section with a plurality of spaced refiner bars which protrude axially from the annular base section and which extend radially along the base section. The refiner bars are formed in alternating regions of generally aligned bars. The bars in one region will curve toward the direction of disc rotation, while the bars in the adjacent region will curve away from the direction of disc rotation. The curved refiner bars provide a less direct hit on the pulp being refined, with anticipated improved plate life and reduced energy required to reach a particular pulp quality. The alternating direction of the refiner bars results in intermittent pumping and holding back of the stock by the refiner bar structure, for improved refining action.

It is a feature of the present invention to provide a disc refiner which efficiently achieves desired pulp quality.

It is another feature of the present invention to provide a refiner disc for a disc refiner having bars which make a reduced hit on the pulp being refined.

It is an additional feature of the present invention to provide a disc refiner with refiner discs which are resistant to erosion and corrosion.

It is a further feature of the present invention to provide a refiner disc for a disc refiner with extended wear life.

It is yet another feature of the present invention to provide refiner discs for a disc refiner which alternately pump the stock outwardly and hold back the outward flow of the stock as the discs rotate with respect to one another.

Further objects, features and advantages of the invention will be apparent from the following detailed description when taken in conjunction with the accompanying drawings.

DESCRIPTION OF THE PREFERRED EMBODIMENT

Figure 1:
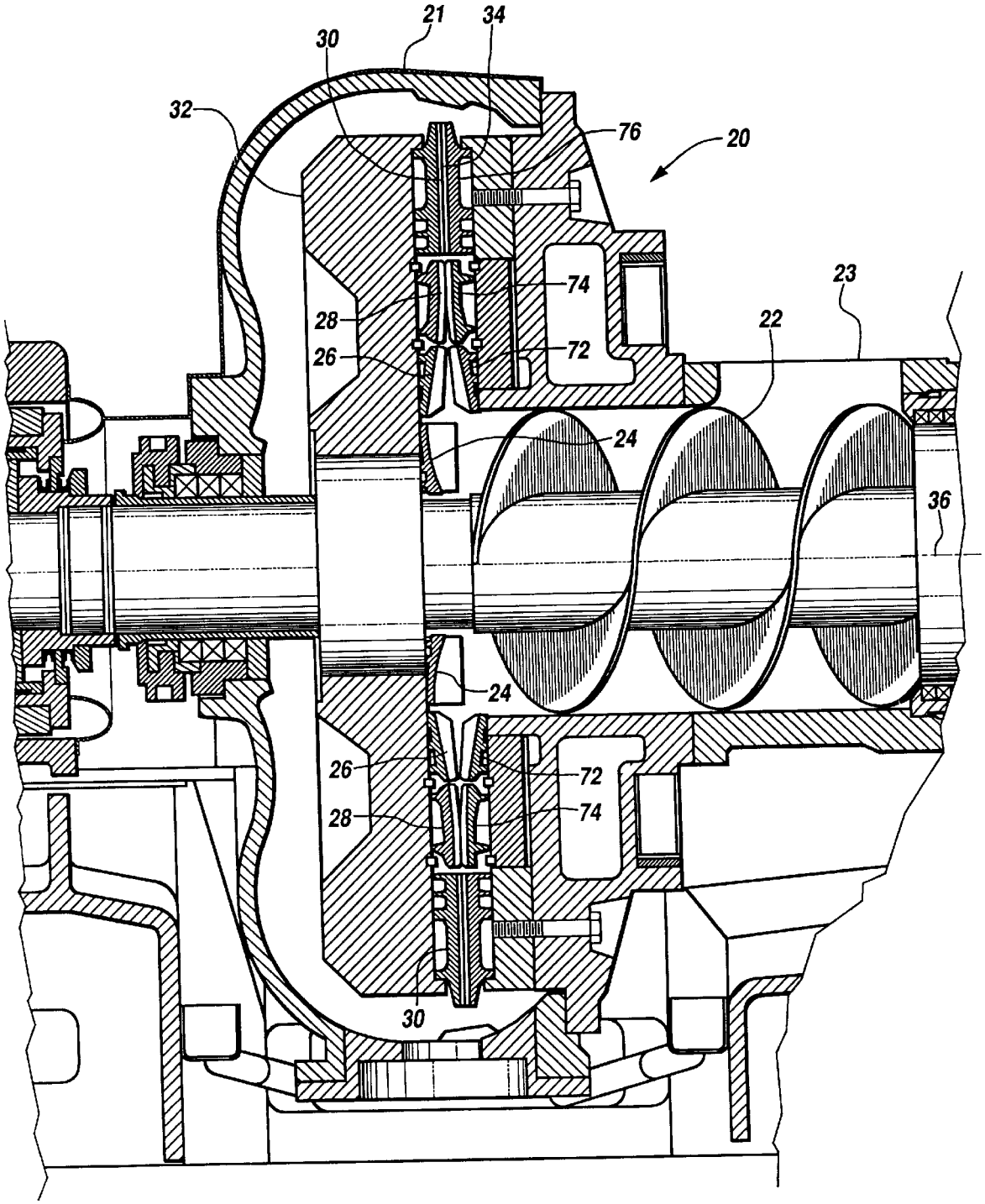
FIG. 1 is a fragmentary cross-sectional view of an exemplary high consistency stock disk refiner which may be used with the refiner bar discs of this invention.

Referring more particularly to FIGS. 1–4, wherein like numbers refer to similar parts, a high-consistency pulp refiner 20 employing the curved refiner bar sections of this invention is shown in FIG. 1. The refiner 20 has a housing 21 and an auger 22 mounted therein which supplies a high consistency pulp or stock from a stock inlet 23. The auger 22 supplies stock to an arrangement of treating structure mounted to the housing 21 and a rotating rotor 32. A flinger nut 24 is aligned with the auger 22 and directs the stock radially outwardly to a plurality of breaker bar segments 26. The breaker bar segments 26 are in the form of sectors of an annulus which together form an encircling section of breaker bars. One set of breaker bar segments 26 is fixed to the rotor 32, and another set 72 is fixed to the housing. The breaker bar segments 26 discharge stock to radially outwardly positioned first refiner discs 28 and second refiner discs 30. One set of the first and second refiner discs or plates 28, 30 is mounted to the rotor 32 parallel to a radially extending plane 34. The rotor 32 and refiner discs 28, 30 rotate about an axis 36. Another set of refiner discs or plates 74, 76 is mounted to the housing.

High consistency stock is eighteen to sixty percent fiber by weight and is in the form of wood chips or semi-chemically treated wood chips which contain fiber clumps. The stock is processed by the refiner 20 to free the individual fibers in the stock in preparation for forming paper. The flinger nut 24 has radial bars which transport the stock radially outwardly under the centrifugal forces developed by the motion of the rotor 32 and the attached flinger nut 24. The breaker bar sections 26 receive stock discharged radially outwardly from the flinger nut 24.

Historically, breaker bar sections have employed straight breaker bars. However, breaker bar sections employing curved refiner bars have been constructed according to the invention of my prior patent application U.S. Ser. No. 08/213,357 now abandoned to a BREAKER BAR SECTION FOR A HIGH CONSISTENCY REFINER, the disclosure of which is incorporated by reference herein. Experiments with the curved breaker bar segments have indicated that curved bars resist erosion and corrosion better than straight bars. Although the fluid mechanics of the pulp action against the moving bars is complex, it is assumed that the curvature of the bars presents a less direct hit to the pulp.

Figure 2:
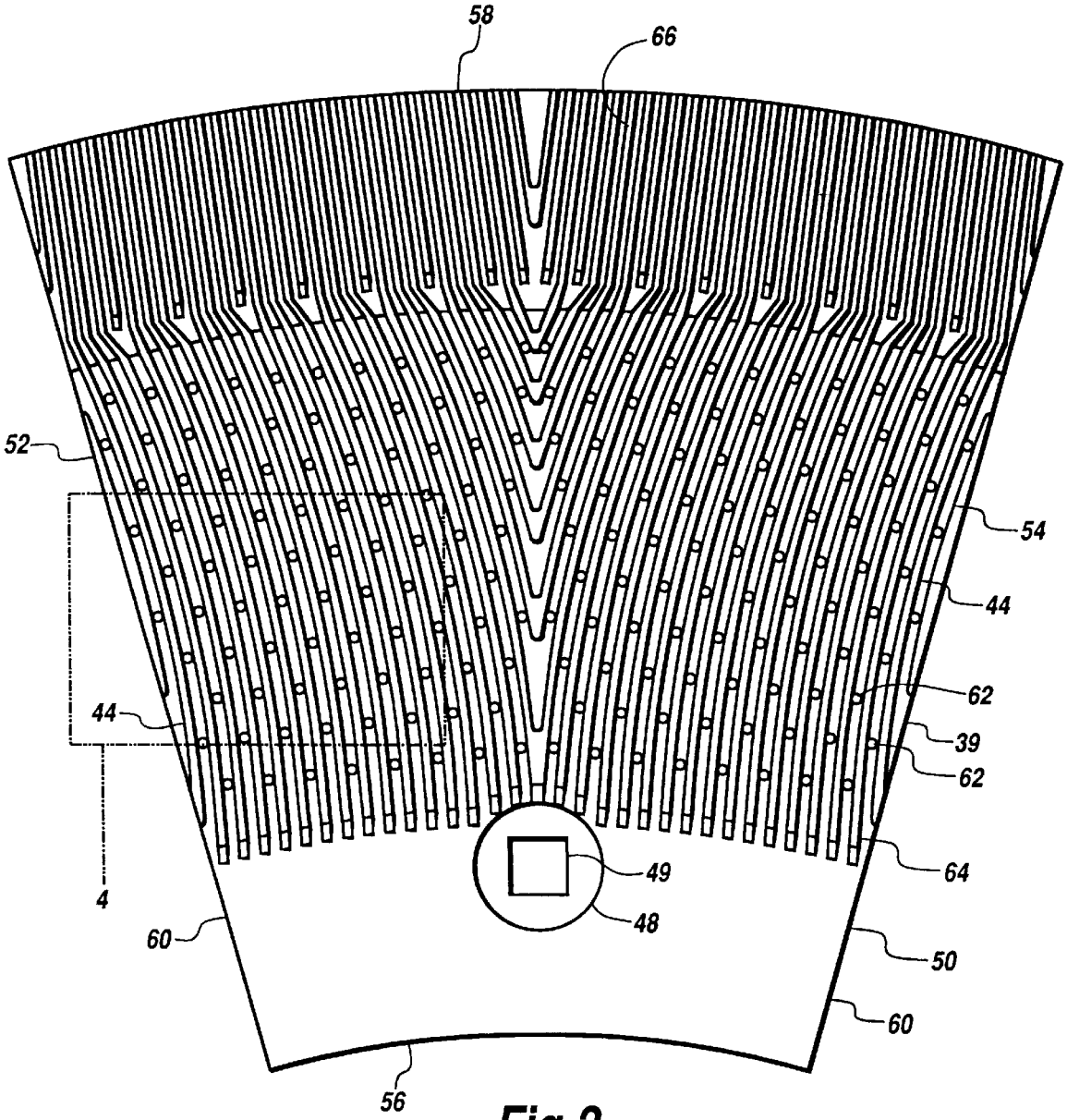
FIG. 2 is a top plan view of a refiner bar segment of this invention showing refiner bars curved in opposite directions arrayed in two regions of like curvature.

The refiner discs or plates 28, 30, 74, 76 are formed of a plurality of sector-shaped segments 39, shown in FIG. 2. Each segment 39 has a countersunk bolt hole 48 through which a fastener 49 extends to connect the segment to the rotor 32 or the housing 21. Each segment 39 has a sector-shaped base 50, such that the segments of a refiner disc combine to form an annular base. Refiner bars 44 protrude axially from the base generally parallel to the rotational axis 36 of the rotor 32. In a preferred embodiment, each sector has two inner regions 52, 54 of curved refiner bars 44. Each refiner bar extends from a position closer to the inner periphery 56 of the segment 39 to a position closer to the exterior periphery 58 of the segment. The refiner bars of both regions are curved to be concave toward respective adjacent sides 60 of the segment 39. The bars of one region curve in the direction of rotation, while the bars of the other region curve opposite to the direction of rotation. By providing multiple regions on a single segment 39, bars of a desired radius of curvature may be obtained. Bars curved in opposite directions will result in a variation of the hit on the fibers within the stock as it passes between oppositely curved refiner bars on opposed discs and like curved refiner bars, as described below.

As shown in FIG. 2, axially extending dams 62 extend between adjacent refiner bars 44. The dams bridge the gap or flow channel 64 between the bars 44. In a preferred embodiment, the tops of the dams 62 are of a height less than the tops of the bars 44 so that the flow of stock is not completely occluded but rather the stock is forced to flow over the dams and so brought to a position where it can be processed by the refiner bars 44. It should be noted, however, that dams may be provided which are at least as high as the bars. Adjacent dams are staggered radially outwardly from one another on the sector segment 39. Dams can also be located in the outer refining area.

Generally radially extending straight refiner bars 66 extend axially from the base at a position radially outwardly from the curved refiner bar regions 52, 54.

As shown in FIG. 1, the refiner bar segments 39 which are mounted to the rotor 32 are parallel to and opposite non-rotating opposed refiner bar segments which are rigidly mounted to the housing 21 and opposed to the refiner bar segments 39.

Figure 3:
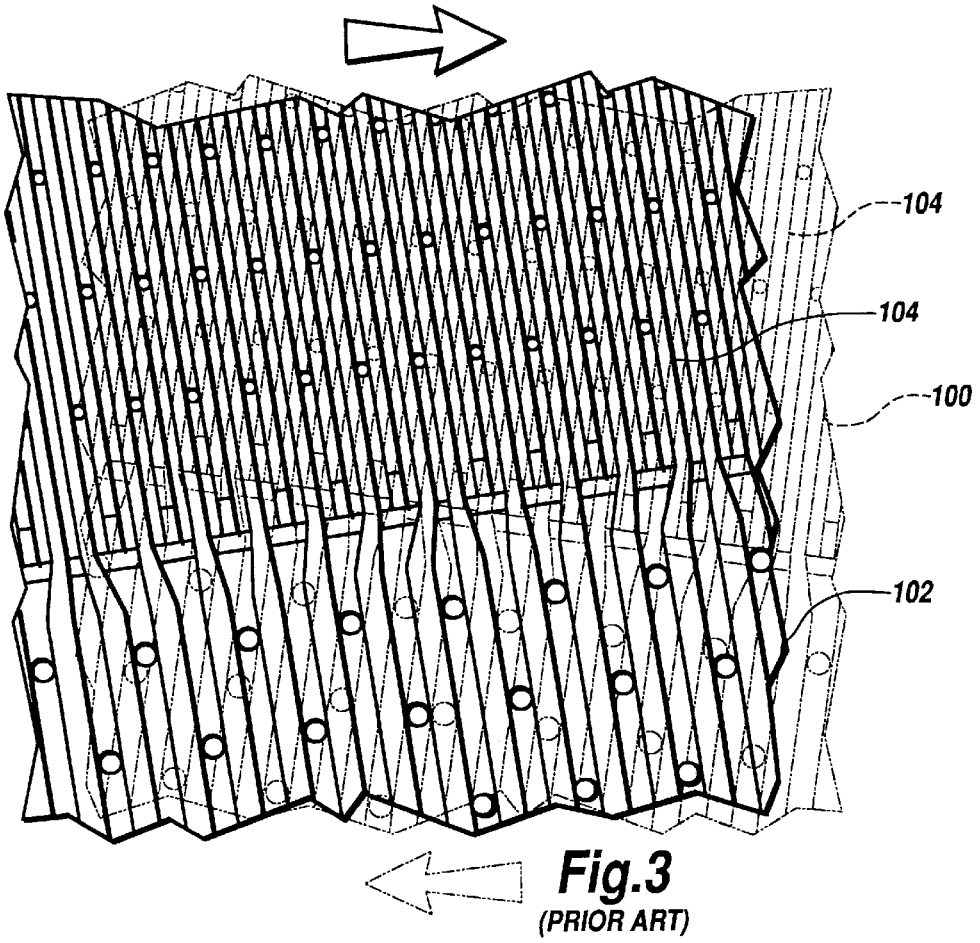
Fig.3 (PRIOR ART)
FIG. 3 is a schematic view of two opposed refiner discs of a prior art refiner.

Operation of the refiner bar segments 39 of the present invention may be compared to the performance of a conventional refiner bar assembly as shown in FIG. 3. The illustrated conventional refiner bars extend essentially outwardly in a strictly rectilinear pattern which is inclined slightly from the strictly radial. A conventional refiner bar segment 100 overlies and rotates with respect to a conventional opposed refiner bar segment 102. As the conventional refiner bar segment 100 rotates with respect to the opposed conventional refiner bar segment 102, the conventional rectilinear refiner bars 104 pass over each other in consistent fashion.

Figure 4:
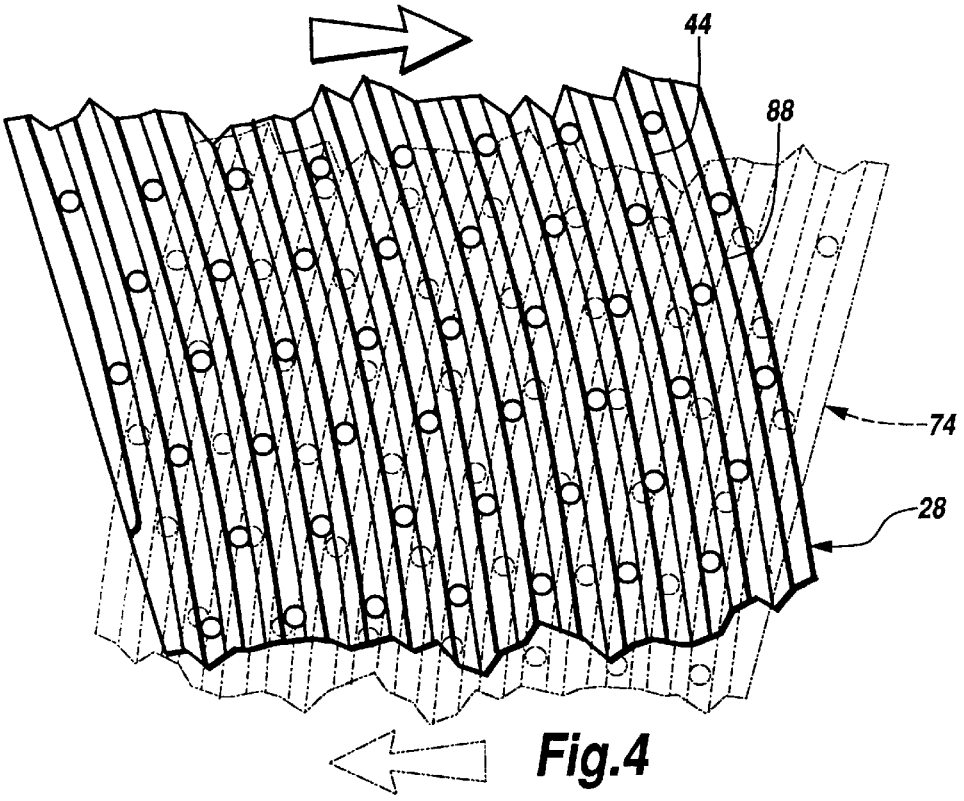
FIG. 4 is superposed view of two refiner discs of the refiner of FIG. 1.

The refiner bars of the segments of the present invention, as shown in FIG. 4, are continuously overlying one another as the refiner discs or plates 28, 74 rotate with respect to one another. The rotor-mounted refiner disc 28, which is composed of an assembly of sector-shaped segments 39 has refiner bars 44 which overlap with the refiner bars of the opposed housing-mounted refiner disc bars. When regions of refiner bars which curve in opposite directions overlap, as shown in FIG. 4, the overlaps 88, which are the intersections of the bars 44 on the opposed discs, sweep radially outwardly. The direction of rotation of the rotating refiner bar segments is shown by the arrows. This motion of the overlaps may be said to have a "pumping" effect on the stock, tending to urge it outwardly.

As shown in FIG. 4, the angle between the refiner bars 44 on the opposed refiner segments increases as the bars extend from the inner periphery 56 to the outer periphery 58, because of the curvature of the bars. In the prior art refiner, shown in FIG. 3, the angle between the opposed refiner bars is generally constant.

Because of the bar curvature, the pulp experiences different angles of bar intersecting angles as the pulp progresses from the inside of the refiner plate to the outside of the refiner plate. Because of the curved bars and varying refining angles along with less direct hits on the pulp, a less intense refining will occur which may lead to lower energy consumption for a particular pulp quality.

Because the segments 39 each have two regions of alternating curvature, the entire refiner disc 28 will consist of a repeating sequence of first a region of refiner bars which curve toward the direction of rotation, and then a region which curves away from the direction of rotation. The opposed refiner disc 74 will have exactly the same arrangement. Thus if the conditions of stock flow are analyzed over one region of refiner bars of the fixed refiner disc 74, it will be seen that bars of like curvature, and then opposed curvature will repeatably pass over one another. Bars of opposed curvature, such as shown in FIG. 4, will pass over in such a way that the more radially inward portions of the bars will cross first, and the overlaps will then move outwardly. This action may be considered to have a pumping effect. Where regions of bars with like curvature cross over, the radially outward portions of the bars will cross first. This action may be considered to retard or "hold back" radially outward stock flow. Intermittent hold back action has traditionally been considered to be desirable in disc refiners.

The pumping and hold-back characteristics created by the alternating overlapping segments can be controlled depending on the desired characteristics necessary for refining a particular material. This is accomplished by altering both the relative angle and curvature of the curved refiner bars as well as the degree of curvature variation over the length of each of the refiner bars. The pumping action however, causes an increase in velocity or an acceleration of the material passing between the discs as the bars of opposed curvature, such as those shown in FIG. 4, pass over one another. In more detail, as the point of overlap between opposed curvature refiner bars moves radially outward relative to the axis of rotation of the discs, the material passing between the disks is forced or pumped radially outward and thus accelerated. The velocity change or acceleration may be easily controlled by selecting an appropriate amount of curvature and rate of change of curvature of the opposed refiner bars.

Similarly, as the refiner bars of a like curvature pass over one another, the point of overlap between opposed refiner bars moves radially inward toward the axis of rotation of the discs. As the point of overlap moves radially inward, the material passing between the refiner discs receives an exerted forced applied radially inward as well. This force produces the retarding or hold back action. This hold back at least slows the velocity of the material being pumped outward and may even stop the outward flow of material. Again, the amount of retardation or hold back is controlled by the amount of curvature of the refiner bars as well as the rate of change of curvature over the length of each refiner bar.

For clarification, bars of opposed curvature on the disks refer to bars which actually mirror one another if the two discs were held stationary with the refiner bars facing one another. Similarly, bars of like curvature actually curve in opposite directions if the refiner discs were held stationary relative to one another with the refiner bars facing one another.

Although the illustrated refiner disc segment has been shown with curved bars in the inner refining zone only, it should be noted that curved bars may be provided in the outer refining zone as well, so both inner and outer refining zones would have curved bars. Alternatively, the inner bars may be straight, and only the outer bars curved; or the refiner disc may have a single refining zone of all curved bars. The amount of bar curvature can vary depending on the type of furnish and other refining parameters.

It should be understood that the refiner discs of this invention may be employed with refiners of various configurations employing various types and consistencies of stock. Although the refiner disc segments are shown to be constructed of annular pie-shaped sectors, they could be formed as continuous annular discs. Furthermore, the refiner discs may be formed as a single annular section, or as plural sections. The refiner bar segments and refiner discs are typically cast of materials such as white cast iron and stainless steel or other alloys combining the features of strength, wear resistance and cost effectiveness.

The refiner discs described and illustrated may be used with any suitable disc refiner and such disc refiner may have one or more rotors and one or more counter-rotating or stationary refiner bar segments and refiner discs.

It is understood that the invention is not limited to the particular construction and arrangement of parts herein illustrated and described, but embraces such modified forms thereof as come within the scope of the following claims.

I claim:

1. A method of refining a stock material, the method comprising the steps of:

providing a pair of refining discs which confront one another, at least a first of the refiner discs having an axis of rotation;

forming a plurality of refiner bars on each of the confronting discs, the refiner bars being axially protruding from the discs and radially extending along the confronting surfaces and being curved relative to a radial direction;

rotating the first refiner disc in a first rotary direction;

passing the stock material between the refiner discs in a direction flowing away from the axis of rotation; and alternately pumping the stock material radially outward away from the axis of rotation and then holding the flow of stock material from flowing radially outward between the discs.

2. The method according to claim 1, wherein the step of passing further comprises:

passing the stock material between opposed first annular sections of the refiner discs, wherein at least one of the opposed first annular sections includes a plurality of first refiner bar segments having the refiner bars curved in the first rotary direction and a plurality of second refiner bar segments having the refiner bars curved opposite the first rotary direction and wherein the plurality of first and second refiner bar segments are alternatingly spaced around the at least one first annular section.

3. The method according to claim 2, wherein the step of passing further comprises:

passing the stock material between opposed second annular sections which are disposed radially outward from the first annular sections, wherein at least one of the opposed second annular sections includes a plurality of third refiner bar segments having the refiner bars curved in the first rotary direction and a plurality of fourth refiner bar segments having the refiner bars curved opposite the first rotary direction and wherein the plurality of third and fourth refiner bar segments are alternatingly disposed around the at least one second annular section.

4. The method according to claim 2, wherein the step of forming further comprises:

forming the refiner bars having a predetermined curvature so that the predetermined curvature increases relative to the radial direction moving away from the axis of rotation, and wherein the step of alternately pumping and holding is conducted via the predetermined curvature of the refiner bars.

5. The method according to claim 1, wherein the step of passing further comprises:

passing the stock material between opposed first annular sections of the refiner discs, wherein each of the opposed first annular sections includes a plurality of first refiner bar segments having the refiner bars curved in the first rotary direction and a plurality of second refiner bar segments having the refiner bars curved opposite the first rotary direction and wherein the plurality of first and second refiner bar segments are alternatingly spaced around each of the opposed annular sections.

6. The method according to claim 5, wherein the step of passing further comprises:

passing the stock material between opposed second annular sections which are disposed radially outward from the first annular sections, wherein each of the opposed second annular sections includes a plurality of third refiner bar segments having the refiner bars curved in the first rotary direction and a plurality of fourth refiner bar segments having the refiner bars curved opposite the first rotary direction and wherein the plurality of third and fourth refiner bar segments are alternatingly disposed around each of the second annular sections.

7. The method according to claim 5, wherein the step of passing further comprises:

passing the stock between refiner bars having a predetermined curvature so that the predetermined curvature increases relative to the radial direction moving away from the axis of rotation, and wherein the step of alternately pumping and holding is conducted via the predetermined curvature of the refiner bars.

8. The method according to claim 1, further comprising the step of:

rotating a second refiner disc of the pair of refiner discs in a second rotary direction opposite the first rotary direction about an axis of rotation concentric with the axis of rotation of the first refiner disc.

9. The method according to claim 1, wherein the step of alternately pumping and holding is conducted via a predetermined curvature of the plurality of curved refiner bars.

10. The method according to claim 9, wherein the step of forming further comprises:

forming the predetermined curvature of the refiner bars so that the predetermined curvature increases relative to the radial direction moving away from the axis of rotation.

11. The method according to claim 1, wherein the step of passing further comprises:

feeding a wood pulp stock material to the housing to be refined for the process of papermaking.

12. A method of refining a stock material, the method comprising:

delivering the stock material to a housing of a disc refiner via a stock inlet, the disc refiner having an auger which rotates on an axis of rotation and moves the stock material axially toward and then radially outward to a pair of opposed refiner discs mounted concentrically relative to the axis of rotation adjacent one end of the auger;

providing a plurality of curved refiner bars axially protruding from and radially extending on each of the pair of refiner discs, the refiner bars of each refiner disc facing one another and curved relative to a radial direction; and rotating at least one the refiner discs in a first rotational direction relative to the other refiner disc such that the stock material is alternately pumped radially outward from the auger between the refiner discs and then held from flowing radially outwardly.

13. The method according to claim 12, further comprising the step of:

rotating each of the refiner discs relative to one another in opposite directions.

14. The method according to claim 12, wherein the step of providing further comprises:

providing a first annular refiner disc section on each of the refiner discs, the first annular disc sections disposed opposite and confronting one another and having thereon a plurality of first refiner bar segments with the refiner bars curved in the first rotational direction and a plurality of second refiner bar segments with the refiner bars curved away from the first rotational direction, the first and second refiner bar segments alternately spaced around each of the refiner discs.

15. The method according to claim 14, wherein the step of providing further comprises:

providing a second annular refiner disc section on each of the refiner discs spaced radially outward from the first annular disc sections, the second annular disc sections disposed opposite and confronting one another and having thereon a plurality of third refiner bar segments with the refiner bars curved in the first rotational direction and a plurality of fourth refiner bar segments with the refiner bars curved away from the first rotational direction, the third and fourth refiner bar segments alternately spaced around each of the refiner discs.

16. The method according to claim 12, further comprising the step of continuously overlapping the curved refiner bars of the refiner discs as at least one of the refiner discs rotates, and pumping the stock material, urging it radially outwardly, by movement of the overlapping curved refiner bars.

17. The method according to claim 12, further comprising the step of generating a varying refining angle from the curved refiner bars, wherein the varying refining angle decreases direct hits on the stock material, and wherein the curved refiner bars, the varying refining angle, and the decreased direct hits lower the energy consumption of the refiner for stock having a particular pulp quality.

18. A method of refining a stock material, the method comprising the steps of:

mounting a first refiner disc within a refiner housing rotatable on an axis in a first rotational direction, the first refiner disc having a plurality of first refiner bar segments axially protruding from one face and radially extending along the one face and curving away from the first rotational direction and having a plurality of second refiner bar segments axially protruding from the one face and radially extending along the one face and curving in the first rotational direction, the first and second refiner bar segments alternately spaced around the first refiner disc;

mounting a second refiner disc within the refiner housing rotatable on an axis in a second rotational direction opposite the first rotational direction, the second refiner disc having a plurality of third refiner bar segments axially protruding from one face and radially extending along the one face and curving in the second rotational direction and having a plurality of fourth refiner bar segments axially protruding from the one face and radially extending along the one face and curving in the first rotational direction, the third and fourth refiner bar segments alternately spaced around the second refiner disc and confronting and spaced from the first and second refiner bar segments of the first refiner disc;

feeding a stock material to be refined into the housing between the first and second refiner discs;

rotating at least the first refiner disc in the first rotational direction; and alternately pumping the stock material radially outwardly from the axis and then holding the stock material from flowing radially outwardly as the first refiner disc rotates.

19. The method according to claim 18, further comprising the step of:

forming the curved refiner bar segments with a curvature that increases moving away from the axis of the refiner discs.

20. The method according to claim 18, further comprising the step of:

rotating the second refiner disc in the second rotational direction.

21. The method according to claim 20, further comprising the step of rotating the first refiner disc and rotating the second refiner disc such that there is relative rotation between the first refiner disc and the second refiner disc.

22. The method according to claim 18, further comprising the step of forming the curved refiner bar segments of the first refiner disc and the second refiner disc with a radius of curvature that increases moving radially away from the axis of the refiner discs such that the step of alternately pumping and holding is conducted via the curvature of the refiner bar segments.

23. The method according to claim 22 wherein the radius of curvature of the curved refiner bar segments of one section of the first refiner disc is the same as the radius of curvature of the curved refiner bar segments of one section of the second refiner disc.

24. A method of refining a stock material comprising:

a) providing a pair of refining discs that 1) have an inner periphery, 2) an outer periphery, and 3) oppose one another with i) at least one of the discs having an axis of rotation, ii) both of the discs having a plurality of upraised, spaced apart and generally radial refiner bars, and iii) wherein for at least one of the discs the bars have a first region wherein the refiner bars are curved toward a direction of rotation of the refining disc having the axis of rotation, and have a second region wherein the refiner bars are curved away from the direction of rotation of the refining disc having the axis of rotation;

b) introducing the stock material between the refining discs; and c) rotating one of the discs relative to the other of the discs such that as refiner bars of one of the refining discs pass by the refiner bars of the other of the refining discs, the angle formed therebetween increases as the refiner bars extend from adjacent the inner periphery to adjacent the outer periphery.

25. The method according to claim 24 wherein both of the opposed refining discs have a first region wherein the refiner bars are curved toward the direction of rotation and have a second region wherein the refiner bars are curved away from the direction of rotation.

26. The method according to claim 25 wherein during step c) the steps further comprising 1) pumping the stock material radially outwardly when the first region of the bars of one of the refining discs generally overlies the second region of the other of the refining discs, and 2) retarding the radial outward flow of the stock material when the first region of the bars of one of the refining discs generally overlies the first region of the bars of the other of the refining discs.

27. The method according to claim 26 wherein during step c) the step further comprising retarding the radial outward flow of the stock material when the second region of the bars of one of the refining discs generally overlies the second region of the bars of the other of the refining discs.

28. The method according to claim 26 wherein the refiner bars in one of the regions of one of the refining discs has the same curvature as the refiner bars in one of the regions of the other of the refining discs.

29. The method according to claim 28 wherein both of the refining discs rotate during step c).

30. The method according to claim 25 wherein during step c) the steps further comprising 1) pumping the stock material radially outwardly when the region of bars of one of the refining discs that are curved in one direction relative to the direction of rotation generally overlies the region of bars of the other of the refining discs that are curved in an opposite direction relative to the direction of rotation, and 2) retarding the radial outward flow of the stock material when one of the regions of the bars of one of the refining discs i) generally overlies and ii) is curved in the same direction as one of the regions of the bars of the other of the refining discs.

31. The method according to claim 25 wherein both of the opposed refining discs are comprised of annular disc segments with each of the disc segments having a first region wherein the refiner bars are curved toward the direction of rotation and having a second region wherein the refiner bars are curved away from the direction of rotation.

* * * * *

UNITED STATES PATENT AND TRADEMARK OFFICE

CERTIFICATE OF CORRECTION

PATENT NO. : 5,975,438
DATED : November 2, 1999
INVENTOR(S) : Gregory Alexander Garasimowicz It is certified that error appears in the above-identified patent and that said Letters Patent is hereby corrected as shown below:

Title page, Item [54] & col. 1, lines 1-2 should read --METHOD OF REFINING A STOCK UTILIZING A REFINER DISC--.

Signed and Sealed this

Twelfth Day of December, 2000

*Attest:*

Q. TODD DICKINSON

*Attesting Officer*

*Director of Patents and Trademarks*